United States Patent [19]

Delia

[11] Patent Number: 4,765,482

[45] Date of Patent: Aug. 23, 1988

[54] PAD DISPENSER

[75] Inventor: Anthony D. Delia, W. Redding, Conn.

[73] Assignee: Bristol-Myers Company, New York, N.Y.

[21] Appl. No.: 135,127

[22] Filed: Dec. 18, 1987

[51] Int. Cl.[4] ..... B65D 1/34

[52] U.S. Cl. ..... 206/555; 206/804; 206/39.6

[58] Field of Search ..... 206/804, 555, 526, 445, 206/39.6, 39.7

[56] References Cited

U.S. PATENT DOCUMENTS

| | | | |
|---|---|---|---|
| 1,191,165 | 7/1916 | Eisenhardt . | |
| 2,281,251 | 2/1940 | Simmons . | |
| 2,568,814 | 7/1947 | Marcellus . | |
| 2,613,011 | 9/1950 | Foreshaw-Smith . | |
| 2,904,205 | 6/1956 | Callery . | |
| 2,983,369 | 3/1958 | Rogovin . | |
| 3,362,530 | 3/1966 | Johnson . | |
| 3,458,078 | 7/1969 | Skidmore | 206/804 |
| 4,140,257 | 2/1979 | Peterson | 206/804 |
| 4,179,040 | 12/1979 | Bateman et al. . | |
| 4,464,552 | 8/1984 | Pawlowski | 206/804 |
| 4,677,906 | 7/1987 | Lowe | 206/804 |

*Primary Examiner*—Joseph M. Moy
*Attorney, Agent, or Firm*—David M. Morse

[57] ABSTRACT

A pad dispenser for moistened treatment pads includes a wide mouth container and a pad elevator which is receivable within the container. The pad elevator has a generally planar pad support platform to whose periphery are joined a plurality of spaced, resilient collets. A generally vertically directed grasping stem is formed in the middle of the platform. A plurality of treatment pads or disks are positionable in a generally on edge array on the pad elevator's platform. Access to these pads is afforded by raising of the pad elevator within the container. Once raised, the pad elevator will be maintained in its elevated position by a sliding interference fit between the elevator collets and the container sidewall.

20 Claims, 3 Drawing Sheets

FIG. 1
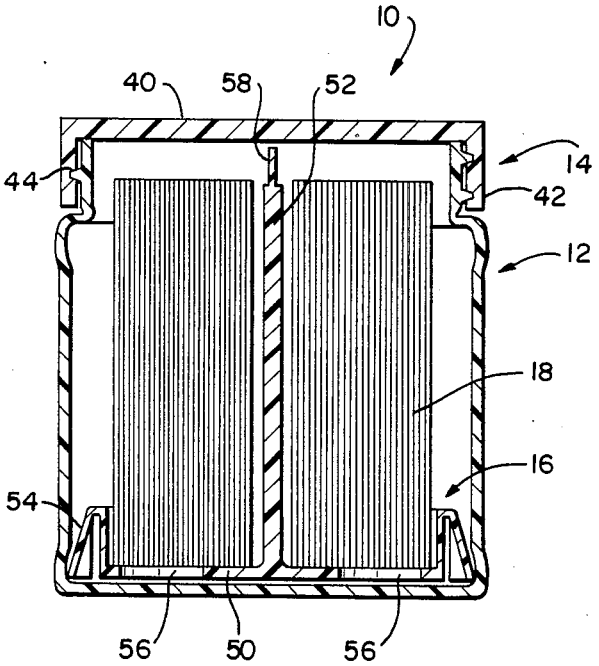
FIG. 2
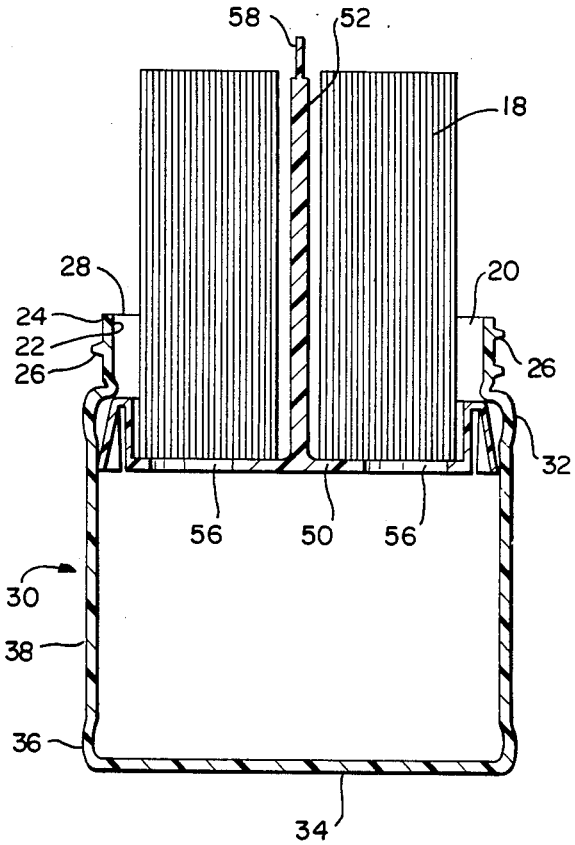
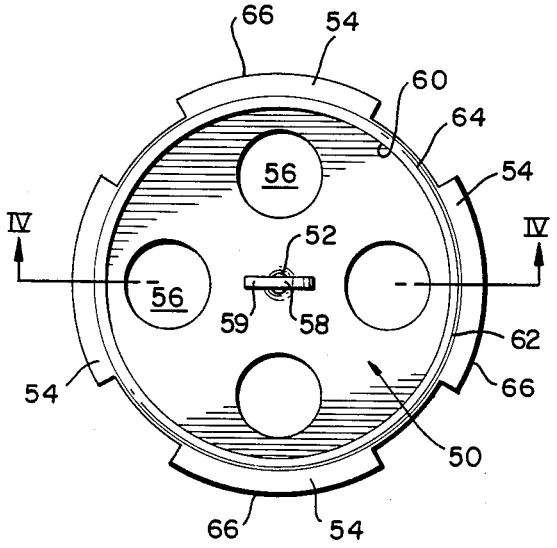
FIG. 3
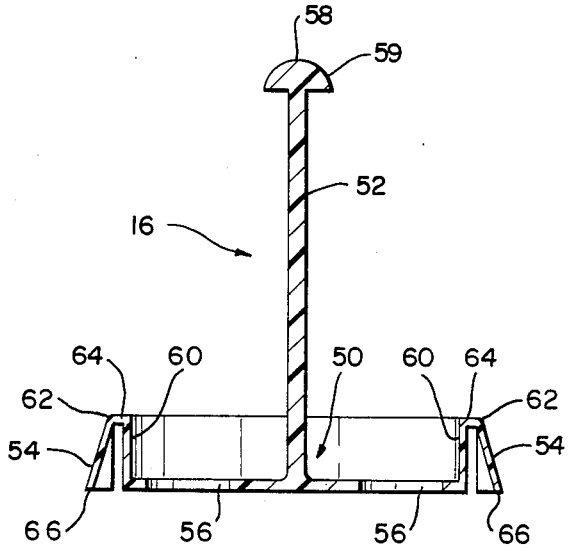
FIG. 4

PAD DISPENSER

FIELD OF THE INVENTION

The present application is directed generally to a pad dispenser. More particularly, the present invention is directed to a holder and dispenser for moistened treatment pads. Most specifically, the present invention is directed to a moistened treatment pad holder and dispenser in which the pads are supported and elevatable within their container by a pad elevator. The pad elevator is slidable within the pad holding container and provides a movable platform which allows the treatment pads to be elevated within their container thereby affording the user easier access to them. The container and pad elevator cooperate to provide a convenient, accessible holder and dispenser for the moistened treatment pads.

DESCRIPTION OF THE PRIOR ART

A wide variety of liquid or fluent medication, treatment, and cosmetic materials are marketed for in the form of moistened fabric pads. These moistened pads, which are typically die cut from a non-woven material and formed in the shape of a disk, are usually packaged in a container, such as a wide mouthed plastic or glass jar, in a vertically aligned stack of fifty or more pads. A stack of pads is usually initially placed in the container in a dry condition, the liquid treatment or medication is then added to the stack, and the container is closed and shipped by the producer. In use, the consumer opens the container and removes the top pad from the stack.

Several problems are inherent with this type of dispensing arrangement for moistened treatment pads. The inner diameter of the container is selected to be only slightly greater than the diameter of the disk-shaped treatment pads. This is done to prevent the treatment pads from moving about in the container and is also done to limit the amount of liquid treatment material needed to moisten the pads. It is relatively easy for the consumer to grasp the uppermost one of the pads from the stack when the container is full but it may become increasingly difficult for him to do so as the supply of pads is depleted and the height of the stack falls further below the mouth of the container. Oftentimes it becomes necessary for the user to invert the container so that the entire stack can be removed to allow one pad to be removed from the stack. Such a procedure is clearly an annoyance and can also result in spillage of the liquid which is placed on the pads and which is apt to collect at the bottom of the container.

A second limitation with these prior arrangements is the possibility of non-uniformity of the absorption of treating liquid by the pads. Whether the pads are pre-moistened prior to placement in a stack within the container or are moistened once they have been placed within the container, some of the treating liquid may eventually settle to the bottom of the container. Thus the pads at the top of the stack might tend to become relatively dry while those at the bottom of the stack may become too moist. The consumer is apt to correct this situation either by periodically placing the container in an inverted position or by removing the entire stack, selecting a pad having the desired amount of liquid from someplace in the middle of the stack, and re-inserting the stack back into the container. Either of these procedures is a source of irritation to the consumer and, in the case of stack handling, may subject the entire stack to possible product contamination.

One prior art solution to the above-discussed problems inherent with placement of stacks of pads in a wide mouthed container is shown in U.S. Pat. No. 2,983,369 to Rogovin. This patent shows a lifting member having a base which supports the stack of pads, and a stem which can be grasped by the consumer to elevate the base and supported stack within the container. Although this prior dispensing package is an improvement over the mere placement of a stack of pads in the container, several problems remain. The base elevating stem of Rogovin is attached to the side of the base. This either requires the pads to be formed having a cut-out peripheral portion so that the stack does not interfere with the stem, or requires the stem to be placed on an extension of the base so that it will not interfere with the stacking of the pads on the base. The first situation wastes pad material while the second requires a larger container which allows the stack to slide about within the container and which also requires the use of additional liquid material. The base and the stem assembly of the Rogovin device also is not structured to hold the stack in a raised position in the container during pad removal and further does not inhibit free removal of the entire stack of pads, if desired. Thus, the Rogovin device requires two hands to use and also does not limit stack removal from the container. Further, in the Rogovin device, the stack of pads are arranged in a generally horizontal orientation which does not alleviate the possibly unequal distribution of treating medium which may occur in such stack arrays.

It will accordingly be appreciated that there is a need for a holder for moistened treatment pads which overcomes the limitations of the prior devices. The pad dispenser in accordance with the present invention provides such a device and is a significant improvement over known assemblies.

SUMMARY OF THE INVENTION

It is an object of the present invention to provide a pad dispenser.

A further object of the present invention is to provide a holder and dispenser for moistened treatment pads.

Another object of the present invention is to provide a moistened pad dispenser having a pad supporting elevator.

Yet a further object of the present invention is to provide a moistened pad dispenser having a pad elevator slidably positioned within the pad container.

Still another object of the present invention is to provide a moistened pad dispenser having a pad elevator with a central stem.

Even yet a further object of the present invention is to provide a moistened pad dispenser having a pad elevator with a circumferential collet that forms an interferenece fit with the pad container.

Yet still another object of the present invention is to provide a moistened pad dispenser which cooperates with a container having a reduced diameter waist.

As will be discussed in greater detail in the description of the preferred embodiment which is set forth subsequently, the pad dispenser in accordance with the present invention includes a generally wide mouthed container and a cooperatively shaped pad elevator. The pad elevator includes a generally planar pad platform which is bounded by a generally outwardly and downwardly directed collet or collets, and which has a central, upwardly extending stem. In usage, a plurality of pads may be placed on their edges on the platform of the pad elevator which may then be slid into the container through the open mouth. Alternatively, the pad elevator may first be placed in the container and the pads then positioned on the platform of the pad elevator. The elevator's resilient collets slidingly engage the sidewalls of the container, which preferably has a central waist portion of a reduced cross-sectional area as will be discussed in greater detail subsequently. In use, the consumer removes the container's cover, grasps the upper end of the stem of the pad elevator, and raises the elevator within the container to a level which affords easy access to the moistened pads. After removing one or more pads, the consumer can push downwardly on the upper end of the stem to lower the stack of pads back down into the container.

The pad dispenser of the present invention provides easy, convenient pad access without regard to the number of pads left in the container. By raising the pad elevator within the container, the user can easily select a pad without difficulty. It is not necessary to invert the container, remove the entire stack from the container, select a pad from the stack, and return the stack to the container, as was the case with prior pad containers. The chances of pad spillage and contamination are accordingly reduced, as are the risks of treatment liquid spillage.

Since the moistened treatment pads are placed on edge on the pad elevator's platform, and further since the platform is provided with spaced apertures which allow liquid to pass to the pads when the elevator is in its lowered position, all of the pads are equally exposed to treating liquid. This allows the consumer to select the most accessible pad, not the one which he perceives to have an amount of treating liquid which suits his needs. All of the pads are made from the same material and all accordingly have the same absorbing characteristics. Thus the pad dispenser in accordance with the present invention provides the user with a plurality of easily grasped pads, all of which carry an equal amount of treatment liquid.

The structure of the pad elevator of the present invention, and its cooperation with the reduced waist container provides a dispenser which is easier to use and which is more convenient than prior devices, such as the Rogovin dispensing package. The resilient collet or collets of the pad elevator are sized to provide a slidable interference fit with the sidewalls of the container. Thus once the pad elevator has been raised within the container and released, it will stay in its elevated position so that the consumer can release the stem and select a pad. Also, since the stem is placed generally in the center of the platform portion of the pad elevator, treatment pads can be placed on edge on either side of the stem. This allows the pad dispenser of the present invention to be used with conventional disk-shaped pads which need not be modified in any way.

The pad dispenser for moistened treatment pads in accordance with the present invention provides an assembly which functions in an efficient manner to store and supply treatment pads. It facilitates access to the pads, exposes all of the pads equally to the liquid placed in the container, and reduces the possibility of spillage or wastage. It provides a pad storage and dispensing arrangement which is significantly better than prior art devices.

BRIEF DESCRIPTION OF THE DRAWINGS

While the novel features of the pad dispenser in accordance with the present invention are set forth with particularity in the appended claims, a full and complete understanding of the invention may be had by referring to the detailed description of the preferred embodiment, as is set forth subsequently, and as illustrated in the accompanying drawings in which;

FIG. 1 is a side elevation view, partly in cross section of the pad dispenser in accordance with the present invention and showing the pad elevator in its lowered, storage position;

FIG. 2 is a side elevation view, generally similar to FIG. 1, and showing the pad elevator in its elevated, dispensing position;

FIG. 3 is a top plan view of the pad elevator; and

FIG. 4 is a cross sectional view of the pad elevator, taken along line IV—IV of FIG. 3.

DESCRIPTION OF THE PREFERRED EMBODIMENT

Referring initially to FIG. 1 there may be seen a preferred embodiment, generally at 10, of a pad dispenser in accordance with the present invention. Pad dispenser 10 includes a wide mouth container, generally at 12, which is provided with a closure 14, and a pad elevator, generally at 16, which is receivable within container 12 and which supports a supply of pads 18. While the pad dispenser 10 in accordance with the present invention will be discussed hereinafter for use in holding and dispensing a plurality of moistened medication or treatment liquid bearing pads, such as an acne medication, a liquid anti-perspirant or the like, it will be understood that its usage is not so limited. Any type of pad or wafer could be supported by pad elevator 16 in container 12 for storage transport, and dispensing.

Container 12, as may be seen in FIGS. 1 and 2, is formed having a generally wide muth 20 which is defined by an upstanding smooth inner mouth wall 22 and an outer mouth wall 24 having one or more screw threads 26 formed thereon. An upper mouth rim 28 is formed at the upper terminus of inner and outer mouth side walls 22 and 24, respectively. Container 12 also preferably has a generally cylindrical body which is defined by a sidewall 30. At its upper end, sidewall 30 may be joined to container mouth 20 by an upper, enlarged diameter flaired sidewall section 32. At its lower end, sidewall 30 may be joined to a generally planar container bottom 34 by a lower, enlarged diameter flaired sidewall section 36. Thus sidewall 30, while being generally cylindrical, is preferably formed having upper and lower flaired or enlarged diameter sections 32 and 36 which are separated by a central, reduced diameter waist wall portion 38. The desirability of this sidewall structure will be discussed shortly. It should be noted at this point that waist wall portion 38 has a cross-sectional size greater than that of wide mouth 20. It should also be noted that while container 12 is preferably generally cylindrical, it need not be, but instead could be of any cross-sectional area.

Container closure 14 has a generally planar upper surface 40 with a downwardly depending annular rim 42. An inner helical recess 44 is formed in annular closure rim 42 and is sized to cooperate with screw threads 26 to allow attachment of cover 14 to the mouth portion 20 of container 12. As will be apparent, the specific type of closure 14 and its attachment to the mouth 20 of container 12 can be varied as long as closure 14 is able to sealingly engage container mouth 20 in a removable and re-securable manner.

Turning now to FIGS. 3 and 4, pad elevator 16 may be seen as including a support platform 50, an upstanding stem 52, and a plurality of spaced circumferentially positioned collets or collet flanges 54. Elevator pad support platform 50 is generally planar and includes one or more spaced apertures 56. When pad elevator is in its storage position, as seen in FIG. 1, these apertures 56 allow liquid which may be placed in the bottom of container 12 to pass upwardly therethrough and into contact with the treatment pads 18 supported by pad elevator 16. The number and location of apertures 56 may be varied so long as their area is sufficient to allow liquid flow while not compromising the support capability of elevator platform 50. While support platform 50 is shown as being generally circular, it will be understood that its shape could vary so long as it is generally the same as the cross-sectional shape of container 12.

Elevator stem 52 is preferably molded integrally with elevator platform 50, which is preferably formed of polypropylene. The stem 52 extends generally vertically upwardly from the center of platform 50 and its height is selected so that an upper end 58 of elevator stem 52 will extend above the upper edges of pads 18, as seen in FIG. 2, but will not interfere with proper securement of closure 14 of container 12, as seen in FIG. 1. It will be readily apparent that the height of stem 52 could be adjusted in concert with various pad heights and container sizes. Stem 52 may have any easily molded cross-sectional configuration and can, if desired, be provided with a grip enhancing upper knob or paddle, as may be seen at 59 in FIGS. 3 and 4.

Platform 50 of pad elevator 16 is bounded by a generally vertically upstanding rim 60 whose height may be varied but which is substantially less than that of stem 52. The spaced circumferential collets or collet flanges 54 are connected at upper ends 62 to an upper perimeter 64 of platform rim 60. As may be seen most clearly in FIG. 4, collet flanges 54 extend downwardly and radially outwardly from elevator rim 60 and end in free collet ends or edges 66 which are positioned generally on the same plane as is pad support platform 50.

A plurality of collets 54 may be formed about the elevator platform rim 60 and may be equally spaced from each other, as is shown most clearly in FIG. 3. The ratio between collet width and spacing width will effect the resiliency or springiness of collets 54. To a certain amount, this resiliency will also be affected by the thickness of the polypropylene or similar material used to mold pad elevator 16. The free or unrestrained diameter of collets 54 is selected to be greater than the inner diameter of central waist wall 38 but less than the inner diameters of upper and lower sidewall enlarged or flaired sections 32 and 36. Further, the fully compressed diameter of collets 54; i.e., when these collets are pressed against platform rim 60, may be less than the inner mouth diameter defined by inner surface 22 of container mouth 20. To facilitate insertion of the pad elevator into container 12. Pad elevator 16 may also be inserted into container 12 by deforming container mouth 20 to an out-of-round configuration and by inserting pad support platform 50 on an angle.

The size relationships between the unrestrained diameter of the collets 54 and the waist and flaired diameters of the container sidewall 30 provides a slidable interference fit of the pad elevator 16 in the container 12 when the pad elevator is in contact with the container waist wall portion 38 while allowing the collets 54 to be unrestricted when the pad elevator 16 is in the lowered shipping or storage position shown in FIG. 1. This size relationship is thus important for several reasons. During shipping and storage of the full container, the pad elevator collets 54 are unrestricted since they are in the lower, flaired section 36 of container 12. Since the collets 54 are unrestricted, they do not take a reduced diameter set, as is apt to occur when a plastic material is restrained for a significant length of time. In use, the pad elevator assembly is raised by grasping knob or paddle 59 positioned at the upper end 58 of stem 52 and pulling up on it. This places collets 54 in a position generally as shown in FIG. 2. In this position, the lower ends 66 of collets 54 are in contact with the reduced diameter waist wall portion 38 of the container body sidewall 30. The inward compression of collets 54 in combination with their tendency to spring or splay radially outwardly is sufficient to hold even a fully loaded pad elevator 16 in the dispensing position shown in FIG. 2. If the consumer should raise pad elevator 16 upwardly to a point in which collets 54 start to engage the inner wall 22 of mouth 20, substantial resistance to further upward motion will be encountered and this will prevent the inadvertent removal of pad elevator 16 from container 12.

It will be understood that the upper and lower flaired wall portions 32 and 36 of container sidewall 30 are shown in a somewhat exaggerated manner in FIGS. 1 and 2 for purposes of illustration. The significant size relationship is, as was discussed above, one in which the collets 54 are unrestricted in the storage position shown in FIG. 1 but form a sliding interference fit with sidewall 38 when in the raised positions shown in FIG. 2. An additional benefit provided by the reduced waist wall 38 is that it prevents adjacent containers from contacting each other in the waist wall portion 38 during storage so that labels affixed to this area do not suffer any damage during shipping and storage.

The pad dispenser in accordance with the present invention provides a simple yet highly effective apparatus for the storage, handling and dispensing of moistened pads. The pads 18 are supported by pad elevator 16 is an on edge configuration which allows them to be readily grasped when the pad elevator 16 is raised and which, as was discussed previously, exposes every pad equally to any liquid that may be present in the bottom of container 12. Thus all the pads carry the same amount of treatment liquid. The pad elevator will maintain itself in a raised dispensing position, such as is depicted in FIG. 2 so that the user does not need to hold the pad elevator in its raised position. The pad elevator of the present invention thus is a highly useful device which is far superior to prior moistened pad containers.

While a preferred embodiment of a pad dispenser in accordance with the present invention has been set forth fully and completely hereinabove, it will be apparent to one of skill in the art that a number of changes in, for example the type of closure applied to the container, the particular pad composition, the type of treatment liquid used, the overall size of the pads, elevator and container, the types of plastics used and the like can be made without departing from the true spirit and scope of the present invention which is accordingly to be limited only by the following claims.

What is claimed is:

1. A pad dispenser assembly usable to store and dispense a plurality of treatment pads, said pad dispenser assembly comprising:

a generally wide mouth container, said container including an open mouth, a sidewall, and a bottom;

closure means securable to said container mouth; and a pad elevator insertable into said container through said open mouth, said pad elevator including a generally planar pad support platform having at least one peripheral collet and a central, generally vertically upstanding stem, said collet and said container sidewall being cooperatively sized to form a slidable interference fit over at least a portion of the height of said sidewall.

2. The pad dispenser assembly of claim 1 wherein said pad support platform has at least one aperture.

3. The pad dispenser assembly of claim 1 wherein said platform is provided with a peripheral upstanding rim.

4. The pad dispenser assembly of claim 1 wherein a plurality of collets are joined at first ends to said platform and extend generally downwardly and outwardly therefrom to free collet ends.

5. The pad dispenser assembly of claim 4 wherein said plurality of collets are equally spaced about said pad support platform.

6. The pad dispenser assembly of claim 1 wherein said container includes at least a central reduced cross-sectional area waist portion and a lower enlarged cross-sectional area flaired portion.

7. The pad dispenser assembly of claim 6 wherein a plurality of collets are joined in a spaced array at first ends to said platform and extend generally downwardly and outwardly to free ends.

8. The pad dispenser assembly of claim 7 wherein said container sidewall waist portion has a cross-sectional area less than the cross-sectional area of said collets.

9. The pad dispenser assembly of claim 7 wherein said container sidewall lower flaired portion has a cross-sectional area greater than the cross-sectional area of said collets.

10. The pad dispenser assembly of claim 1 wherein said pad support platform is generally circular.

11. The pad dispenser assembly of claim 1 wherein said pad elevator is polypropylene.

12. A pad elevator insertable into the interior of a wide mouth container and usable to support and dispense treatment pads stored in said container on said pad elevator, said pad elevator comprising:

a generally planar pad support platform, said platform being shaped generally to correspond to a cross-sectional shape of the container into which it is insertable;

at least a first resilient collet attached at a first end to a periphery of said pad support platform and extending generally away from said platform, said collet being sized to form a slidable interference fit with the container into which said pad elevator is insertable; and a generally vertically upstanding stem attached at a first end generally to a central portion of said platform and generally perpendicular thereto.

13. The pad elevator of claim 12 wherein said pad support platform has at least one aperture.

14. The pad elevator of claim 12 wherein said pad support platform is formed with a peripheral upstanding rim.

15. The pad elevator of claim 14 wherein said first end of said at least one collet is attached to said rim.

16. The pad elevator of claim 15 wherein a plurality of spaced collets are attached at said first ends to said rim.

17. The pad elevator of claim 12 wherein said free end of said at least first collet is generally co-planar with said pad support platform.

18. The pad elevator of claim 12 wherein said pad elevator is molded from polypropylene.

19. The pad elevator of claim 13 wherein said platform is provided with a plurality of spaced apertures.

20. The pad elevator of claim 16 wherein there are four equally spaced collets.

* * * * *